United States Patent [19]

Woodruff

[11] Patent Number: 4,629,238

[45] Date of Patent: Dec. 16, 1986

[54] PALLET PULLER

[76] Inventor: Billy R. Woodruff, 228 4th St., McFarland, Calif. 93250

[21] Appl. No.: 725,333

[22] Filed: Apr. 22, 1985

[51] Int. Cl.[4] ..... B66C 1/42

[52] U.S. Cl. ..... 294/92; 294/82.1

[58] Field of Search ..... 294/1.1, 15, 62, 67.2, 294/82.1, 82.11, 82.13, 85, 86.4, 86.24, 86.1, 89, 92, 93, 97, 101, 82.17; 280/480, 24

[56] References Cited

U.S. PATENT DOCUMENTS

| | | | |
|---|---|---|---|
| 560,329 | 5/1896 | Sherman | 294/89 |
| 1,305,135 | 5/1919 | Loney | 294/82.17 |
| 1,422,228 | 7/1922 | Shaffer | 294/82.1 |
| 2,808,286 | 10/1957 | Lyon | 294/92 X |
| 3,073,613 | 1/1963 | Bergstrom | 294/82.1 X |
| 3,452,963 | 7/1969 | Holst et al. | 294/92 X |
| 3,531,149 | 9/1970 | Klueber | 294/82 X |
| 3,616,952 | 11/1971 | Aguilar et al. . | |
| 3,727,966 | 4/1973 | Stockwell | 294/82.1 |
| 3,807,786 | 4/1974 | Alegria | 294/104 |
| 4,094,544 | 6/1978 | Spaine | 294/82.1 |
| 4,421,353 | 12/1983 | Smith, Jr. | 294/82.1 |

FOREIGN PATENT DOCUMENTS

| | | | |
|---|---|---|---|
| 855768 | 11/1952 | Fed. Rep. of Germany | 294/92 |

*Primary Examiner*—Johnny D. Cherry
*Attorney, Agent, or Firm*—Sheldon & Mak

[57] ABSTRACT

A pallet puller for connecting a drag line to a loaded pallet comprises a cylindrical bearing member having a blade member at one end and an upwardly slanted tongue extending from the opposite end. A length of chain attached to the tongue can be hooked to the drag line. With the bearing member resting on a bottom transverse board of the pallet, or directly on a supporting surface, the blade member is driven into engagement with the underside of the platform, or between separated planks thereof, as tension is applied to the drag line, moving the pallet to a desired location.

13 Claims, 5 Drawing Figures

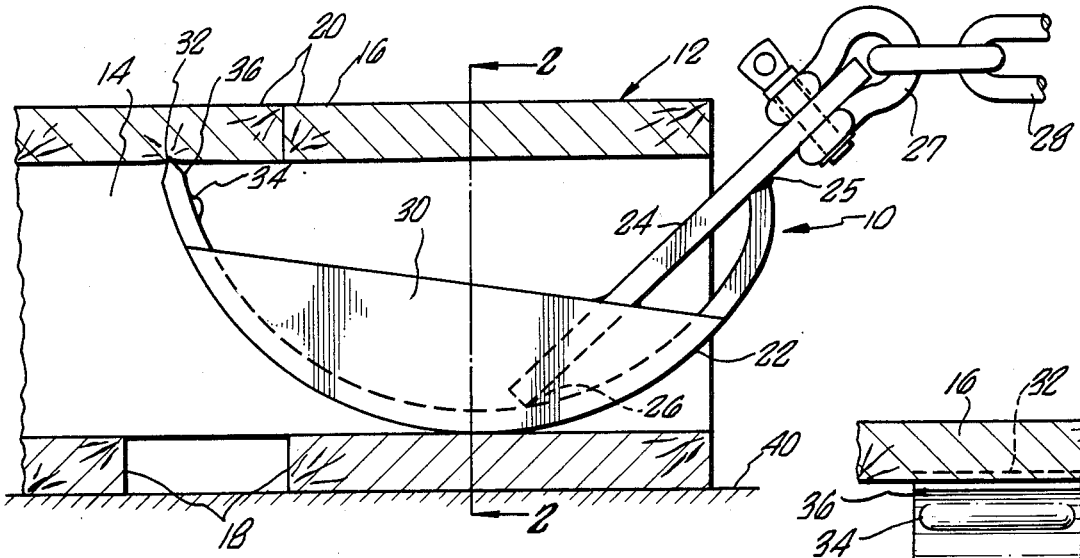
FIG. 1.
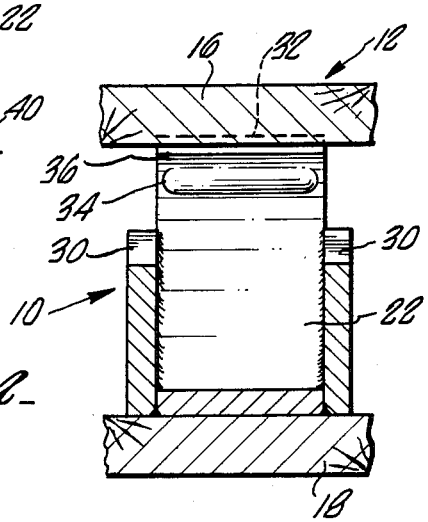
FIG. 2.
FIG. 3.
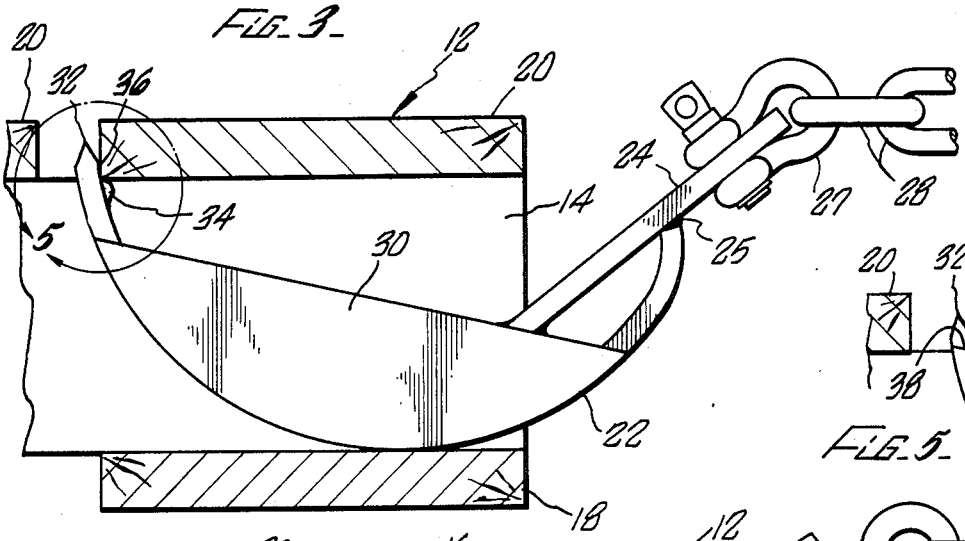
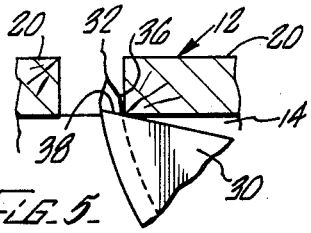
FIG. 5.
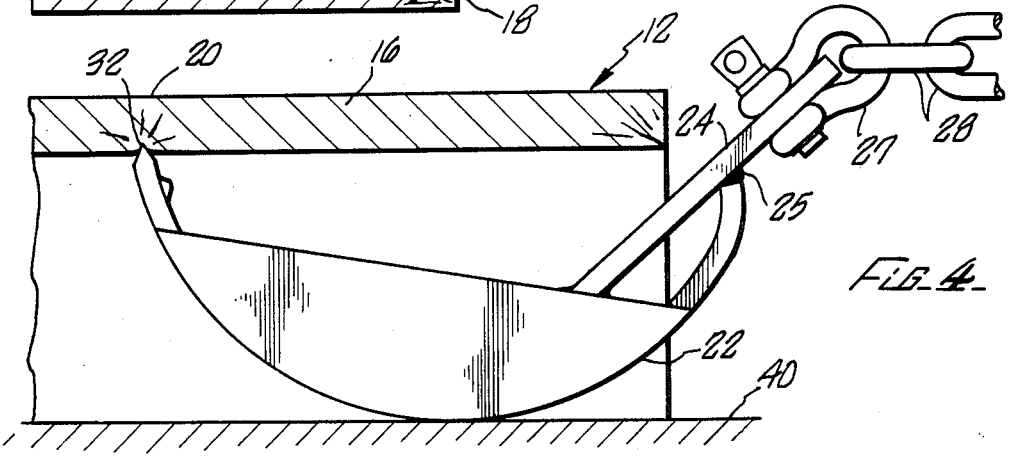
FIG. 4.

PALLET PULLER

BACKGROUND

This invention relates to pallet handling equipment, and more particularly to a puller for connecting a drag line to a loaded pallet for relocating the pallet.

Devices for connecting a drag line to a loaded pallet are known in the prior art. For example, U.S. Pat. No. 3,807,786 to Alegria describes a scissors-type clamp having toothed jaws for engaging opposite sides of a central joist of the pallet. Clamping force is generated by tension in a draw chain connecting the clamp to a vehicle for moving the pallet.

A disadvantage of the Alegria clamp is that the jaws can slip out of engagement with the joist. The joist is typically a wood member with the wood grain running lengthwise. The teeth of the jaws, being oriented across the grain, do not penetrate sufficiently deep into the joist for moving a heavily loaded pallet. Thus the jaws tend to slip along the grain of the joist instead of biting into the wood.

Another disadvantage of the Alegria clamp is that the jaw mechanism comprises a number of moving parts. Consequently, it is expensive to make, subject to wear, and dangerous to use.

Other prior art pallet-connecting devices hook behind a transverse board of the pallet. See, for example, U.S. Pat. No. 4,094,544 to Spaine, and U.S. Pat. No. 4,421,353 to Smith, Jr. These devices require access behind a transverse board of the pallet for engaging the hook. These hook-type devices are difficult or impossible to use unless the pallet has transverse boards that are separated sufficiently to clear the hook (open construction). Thus pallets that have solid panel (closed) construction for carrying fragile loads such as sacks of cement cannot be engaged by the hook. Moreover, when there are separated, transverse boards above, but not below the joist, these devices are difficult to keep hooked until tension can be applied to the drag line.

Thus there is a need for a pallet puller that is reliable, safe, inexpensive, and easy to use on a pallet of open or closed construction, whether or not the pallet has transverse boards below the joist.

SUMMARY

The present invention is directed to a pallet puller that satisfies this need. The puller, which can be used for engaging a loaded pallet having longitudinal ribs and a load-supporting panel connecting top surfaces of the ribs, the ribs resting directly on a supporting surface for the pallet, comprises a bearing member having a cylindrical bottom surface, a blade member extending tangentially from the cylindrical bottom surface, and a tongue member rigidly connected to the bearing member opposite the blade member for connecting a line. When a horizontal force is applied to the line, the blade is driven upwardly into engagement with the panel, effectively connecting the line to the pallet, enabling the pallet to be moved by the line, the bearing member carrying some of the load and acting as a skid, facilitating movement of the pallet over the supporting surface.

When the load-supporting panel has spaced, transverse planks, the blade can easily be hooked behind one of the planks. Otherwise, the blade is driven into engagement penetrating the underside of a plank. The blade member, extending tangentially from the cylindrical bottom surface of the bearing member, is naturally oriented in parallel with the plank and thereby aligned with the grain of the plank. Consequently, the blade can easily penetrate the plank sufficiently to effectively and reliably transmit tension in the line to the pallet for moving the pallet and its load.

The pallet puller of the present invention can also be used with a pallet having a transverse board connecting bottom surfaces of the ribs. In this application, the bearing member rests upon the transverse board.

Preferably the puller is provided with a pair of gusset members on opposite sides of the bearing member for strengthening the bearing member. The gusset members, being flush with the cylindrical bottom surface of the bearing member, enhance the lateral stability of the puller. The gusset members are also fastened to the tongue member for strengthening the attachment of the tongue member to the bearing member.

Preferably the puller includes means for preventing the blade member from extending between separated transverse planks of the panel to a point above the top surface of the panel. Thus fragile loads are not damaged by the blade. The means for preventing can be a transverse bead member on the blade member, the bead member protruding toward the tongue member. When the blade member extends between the planks, the bead member contacts the underside of a plank, preventing further upward movement of the blade member. Alternatively, the tops of the gusset members can be located at a distance slightly less than the thickness of the planks below the top of the blade member, providing a stop for preventing the blade member from extending above the planks.

Preferably a length of chain is attached to the tongue for facilitating connection of the line. Thus a hook, attached to the line, can conveniently engage a link of the chain.

Preferably the bottom cylindrical surface of the bearing member has a radius of from about $3\frac{1}{2}$ inches to about 5 inches and, with the puller, resting on a level surface and the blade extending $3\frac{5}{8}$ inches above the level surface, the line intersects the tongue at a point located approximately 4 to 6 inches above the level surface. This configuration of the pallet puller advantageously permits reliable engagement with a pallet having any common configuration, whether the ribs are of conventional $3\frac{5}{8}$ inch height, or of any height between $2\frac{5}{8}$ inches and $4\frac{5}{8}$ inches.

The present invention also provides a method for engaging a pallet having a load-supporting panel on longitudinal ribs, the ribs resting directly on a supporting surface for the pallet, the method comprising:

(a) selecting a pallet puller comprising a cylindrical bearing member, a blade member extending tangentially from the bearing member, and a tongue member opposite the blade member;

(b) placing the puller with the bearing member on the supporting surface and the blade member contacting the panel;

(c) connecting a line to the tongue member; and (d) pulling horizontally on the line for moving the pallet to a desired location, the blade member being driven upwardly against the panel.

The blade member can bite into the bottom surface of the panel or, when the panel comprises separated planks, the method can include placing the blade member between the planks so that it hooks behind a plank as described above.

Similarly, when the pallet has a transverse board connecting bottom surfaces of the ribs, the bearing member is placed on the transverse board.

The pallet puller is advantageously of unitary construction, avoiding the expense, wear, and danger inherent in complicated clamp-type mechanisms.

Thus the pallet puller of the present invention is effective and reliable for connecting a drag line to a wide variety of loaded pallets, is not subject to wear, yet is inexpensive to make, safe, and easy to use.

DRAWINGS

These and other features, aspects, and advantages of the present invention will become better understood with the reference to the following description, appended claims, and accompanying drawings where:

FIG. 1 is a fragmentary sectional side elevational view of the pallet puller of the present invention engaging a pallet between an upper platform and a lower transvese board of the pallet;

FIG. 2 is a fragmentary sectional elevational view of the puller of FIG. 1 taken along line 2—2 in FIG. 1;

FIG. 3 is a side elevational view of the puller of FIG. 1 hooked behind an upper plank of the platform;

FIG. 4 is a side elevational view of the puller of FIG. 1 in engagement between an upper platform of the pallet and a stationary surface supporting the pallet, the pallet having no lower transverse board, and FIG. 5 is a fragmentary side elevation showing an alternative configuration of the puller of FIG. 1 within region 5 of FIG. 3.

DESCRIPTION

The present invention is directed to a pallet puller for connecting a drag line to a loaded pallet. Once connected, the drag line can be used to move the pallet from a relatively inaccesible location to a desired location, from which it can be more conveniently handled. With reference to FIGS. 1 and 2, the pallet puller 10 is engaged with a pallet 12. The pallet 12, representative of those in common use, comprises a plurality of rib members or joists 14 on which rests a platform 16 for carrying a load (not shown). One or more transverse boards 18 connect the bottom surfaces of the joists 14. The platform 16 can be a plywood panel or, more commonly, a plurality of transverse planks 20. As shown in FIG. 1, the transverse planks 20 are not spaced apart.

The pallet puller 10 comprises a cylindrical U-shaped bearing member 22, to which is rigidly attached an upwardly slanted tongue 24. The bearing member 22 is a curved strip of steel, a first end 25 being welded to one side of the tongue 24, the lower end of the tongue 24 being welded to an intermediate point 26 on the inside surface of the bearing member 22.

A clevis 27 connects a short length of chain 28 to the upper end of the tongue 24. The hook of a drag line (not shown) can conveniently be connected to the chain 28. The drag line can be chain, but should not, for safety reasons, comprise a springy material such as nylon.

A pair of gusset members 30 are welded to opposite sides of the bearing member 22 and the tongue 24 for strengthening the bearing member 22 and the attachment of the tongue 24 thereto. Preferably the gusset members are flush with the cylindrical bottom surface of the bearing member 22 for increasing the effective width of the bearing member 22. Thus the gusset members 30 provide enhanced lateral stability for the pallet puller 10, resisting any tendency for the pallet puller to tip over when in use.

A blade member 32, which can be a continuation of the bearing member 22, extends tangentially from the bearing member 22 opposite the tongue 24. When the pallet puller 10 is placed within the pallet 12, the bearing member 22 resting on one of the transverse boards 18, the weight of the tongue 24 and the chain 28 urges the blade member 32 into contact with the platform 16. Thus, when tension is applied to the drag line in a horizontal direction, the pallet puller 10 rocks slightly on the bearing member 22, driving the blade member 32 upwardly into the platform 16.

The pallet 12 is typically constructed of ordinary lumber, the joists 14 being two by fours ($1\frac{5}{8}$ inches thick by $3\frac{5}{8}$ inches high, net), the transverse boards 18 and the transverse planks 20 being one by sixes (182 inch thick by $5\frac{5}{8}$ inches wide, net).

Accordingly, the bearing member 22 has a relatively large outside radius of approximately 4.3 inches and, when the pallet puller 10 is resting on a level surface with the blade member 32 extending $3\frac{5}{8}$ inches above the level surface, the intersection of the drag line with the tongue 24, at the clevis 27, is located approximately 5 inches above the level surface. In this configuration, the pallet puller 10 is capable of engaging a pallet 12 having a joist 14 of from approximately $2\frac{1}{2}$ inches to approximately $4\frac{5}{8}$ inches high, as well as the typical height of $3\frac{5}{8}$ inches.

It is anticipated that the bearing member 22 can have an outside radius of from approximately 3.5 inches to approximately 5.0 inches and, when the pallet puller 10 is resting on a level surface with the blade member 32 extending $3\frac{5}{8}$ inches above the level surface, the intersection of the drag line with the tongue 24, at the clevis 27, can be located from approximately 4 to approximately 6 inches above the level surface.

It should be understood that the outside radius of the bearing member 22 need not be constant. In other words, the cylindrical U-shape of the bearing member 22 need not be circular. In fact, as shown in the drawings, the portion of the bearing member 22 between the first end 25 and the gusset members 30 is curved more sharply for clearing the clevis 27. Moreover, the portion of the bearing member 22 that can support the pallet puller 10 need not be curved to a constant radius.

Preferably the end of the blade member 32 and the intersection of the drag line with the tongue 24 subtend an angle of from about 85 degrees to about 105 degrees about a point of contact between the cylindrical surface and the level surface, when the blade member 32 extends $3\frac{5}{8}$ inches above the level surface. This angular relationship, combined with the relatively large outside radius of the bearing member 22, advantageously provides clearance between the tongue 24 and the platform 16 and sufficient leverage for reliably engaging the blade member 32 with the platfom 16, over the range of heights of the joist 14 described above.

In use, the pallet puller 10 is placed under the platform 16 of the pallet 12, with the tongue 24 extending from beneath the platform 16 in a direction paralleling the joists 14, the pallet puller 10 being located in a transverse direction approximately in line with the center of gravity of the loaded pallet. The weight of the tongue 24 and the chain 28 biases the blade member 32 upwardly into engagement with a transverse plank 20 of the platform 16, with the blade member 32 oriented in parallel with the grain direction of the plank 20.

The drag line is connected to the chain 28, either before or after the placement of the pallet puller 10, then the drag line is pulled toward the desired location of the pallet. A horizontal force applied to the drag line is transmitted to the tongue 24 by the chain 28 and the clevis 27. The horizontal force applied to the tongue 24 tends to rock the pallet puller 10 on the bearing member 22 in a direction raising the blade member 32 into engagement with the transverse plank 20. The blade member 32, being aligned in parallel with the grain direction of the transverse plank 20, bites into or penetrates the transverse plank 20 to a depth sufficient to insure reliable coupling of the horizontal force into the pallet 12 for moving the pallet 12 and a load carried thereon. Thus the loaded pallet 12, connected to the drag line by the pallet puller 10, can be moved to the desired location by pulling on the drag line.

With reference to FIG. 3, the blade member 32 of the pallet puller 10 can be inserted between a separated pair of the transverse planks 20 of the pallet 12. A bead member 34, welded to the blade member 32, facing the tongue 24, prevents the blade member 32 from protruding above the top surface of the transverse planks 20. Thus a fragile load is not subject to being damaged by the blade member 32. In this position, a side portion 36 of the blade member 32 hooks behind a transverse plank 20 of the pallet 12.

Alternatively, the tops of the gusset members 30 can be properly located as shown in FIG. 5 to provide a stop 38 for the blade member 32, preventing damage to the load by the blade member 32 as described above.

With reference to FIG. 4, the pallet puller 10 can also be used with pallets having no transverse boards beneath the joists 14. In this application, the bearing member 22 rests directly on a supporting surface 40 on which the pallet 12 rests. When a horizontal force is applied to the tongue 24 through the chain 28 and the clevis 27, the blade member 32 is driven into engagement with the transverse plank 20 as described above. The bearing member 22 acts as a skid, carrying a portion of the combined weight of the pallet 12 and its load. On a surface subject to wear and tear, such as the bed of a truck, the cylindrical surface of the bearing member 22 acts to prevent either the pallet 12 or the pallet puller 10 from digging into the supporting surface 40.

In this application, moreover, the pallet puller 10 acts to lift the pallet 12 over minor irregularities in the supporting surface 40, advantageously reducing the force required to move the pallet 12, and avoiding potential damage of the joists 14.

The pallet puller 12, being constructed as a single rigid unit, is not subject to the expense, wear, and danger inherent in clamp-type mechanisms that are inherently complicated.

The pallet puller 10, moreover, is capable of reliably connecting a drag line to a pallet 12, whether the pallet is of open or closed construction, whether the pallet has transverse boards 18 beneath its joists 14 or not, and whether the joists are conventionally $3\frac{5}{8}$ inches high, as low as $2\frac{5}{8}$ inches, or as high as $5\frac{5}{8}$ inches.

Although the present invention has been described in considerable detail with reference to certain preferred versions thereof, other versions are possible. For example, rather than being of welded steel construction, the pallet puller 10 can comprise a casting or a forging. Further, other materials, such as aluminum, can be used. Moreover, the chain 28 can be welded or hooked to the tongue 24. Therefore the spirit and scope of the appended claims should not necessarily be limited to the description of the preferred versions contained herein.

What is claimed is:

1. A pallet puller capable of engaging a loaded pallet having longitudinal ribs and a load-supporting panel connecting top surfaces of the ribs, the ribs resting directly on a surface supporting the pallet, the puller comprising:

(a) a bearing member having a cylindrically curved bottom surface;

(b) a blade member extending tangentially from the curved bottom surface of the bearing member for contacting the panel;

(c) a tongue member rigidly connected to the bearing member opposite the blade member for connecting a line; and (d) means for preventing the blade member from extending above the panel when the panel comprises separated transverse planks, the blade member extending between the transverse planks, wherein a horizontal force applied to the line produce an upward force component driving the blade member into engagement with the panel for movement of the pallet by the line to a desired location, and the bearing member functions as a skid against the surface supporting the pallet for facilitating the movement of the pallet.

2. The pallet puller of claim 1 further comprising a pair of gusset members rigidly attached to opposite sides of the bearing member for strengthening the bearing member, the gusset members being flush with the curved bottom surface for lateral stability of the puller, the gusset members also being rigidly attached to the tongue member for strengthening the rigid connection of the tongue member to the bearing member.

3. The pallet puller of claim 2 wherein the means for preventing is the tops of the gusset members being located proximate to the blade member.

4. The pallet puller of claim 1 wherein the means for preventing is a bead member rigidly attached transversely to the blade member and protruding toward the tongue member.

5. The pallet puller of claim 1 wherein the panel comprises wood having a grain orientation perpendicular to the ribs, the blade member being oriented in parallel with the grain when the tongue member is positioned in parallel with the ribs for facilitating penetration of the blade member into the bottom surface of the panel when the horizontal force is applied to the line.

6. The pallet puller of claim 1 including a length of chain attached to the tongue member for facilitating connection of the line.

7. The pallet puller of claim 1 wherein the curved bottom surface has a radius of from about $3\frac{1}{2}$ inches to about 5 inches and, when the puller is resting on a level surface with the blade member extending $3\frac{5}{8}$ inches above the level surface, the intersection of the line with the tongue member is located from about 4 to about 6 inches above the level surface.

8. The pallet puller of claim 7 wherein the distance between the end of the blade member and the intersection subtends an angle of from about 85 to about 105 degrees about a point of contact between the curved surface and the level surface.

9. A pallet puller capable of engaging a loaded pallet having longitudinal ribs and a load-supporting panel connecting top surfaces of the ribs, the ribs resting directly on a surface supporting the pallet, the puller comprising:

(a) a bearing member comprising a cylindrically curved bottom surface, the curved bottom surface havign a radius of from about 3½ inches to about 5 inches;

(b) a blade member extending tangentially from the curved bottom surface of the bearing member for contacting the panel;

(c) a tongue member rigidly connected to the bearing member opposite the blade member for connecting a line;

(d) a pair of gusset members rigidly attached to opposite sides of the bearing member for strengthening the bearing member, the gusset members being flush with the cylindrical bottom surface for lateral stability of the puller, the gusset members also being rigidly attached to the tongue member for strengthening the rigid connection of the tongue member to the bearing member;

(e) means for preventing the blade member from extending above the panel when the panel comprises separated transverse planks, the blade member extending between the transverse planks; and (f) a length of chain attached to the tongue member for facilitating connection of the line, wherein, when the puller is resting on a level surface with the blade member extending 3⅝ inches above the level surface, the intersection of the line with the tongue member is located from about 4 to about 6 inches above the level surface, and wherein a horizontal force applied to the line produces an upward force component driving the blade member into engagement with the panel for movement of the pallet by the line to a desired location, and the bearing member functions as a skid against the surface supporting the pallet for facilitating the movement of the pallet.

10. A pallet puller capable of engaging a loaded pallet having longitudinal ribs, a load-supporting panel connecting top surfaces of the ribs, and a transverse board connecting bottom surfaces of the ribs, the puller comprising:

(a) a bearing member having a cylindrically curved bottom surface;

(b) a blade member extending tangentially from the curved bottom surface of the bearing member for contacting the panel;

(c) a tongue member rigidly connected to the bearing member opposite the blade member for connecting a line; and (d) means for preventing the blade member from extending above the panel when the panel comprises separated transverse planks, the blade member extending between the transverse planks, wherein a horizontal force applied to the line produces an upward force component driving the blade member into engagement with the panel for movement of th e pallet by the line to a desired location, and the bearing member functions as a skid against the surface supporting the pallet for facilitating the movement of the pallet.

11. The pallet puller of claim 10 wherein the panel comprises wood having a grain orientation perpendicular to the ribs, the blade member being oriented in parallel with the grain when the tongue member is positioned in parallel with the ribs for facilitating penetration of the blade member into the bottom surface of the panel when the horizontal force is applied to the line.

12. A pallet puller capable of engaging a loaded pallet having longitudinal ribs and a load-supporting panel connecting top surfaces of the ribs, the ribs resting directly on a surface supporting the pallet, the puller comprising:

(a) a bearing member having a cylindrically curved bottom surface;

(b) a blade member extending tangentially from the curved bottom surface of the bearing member for contacting the panel;

(c) a tongue member rigidly connected to the bearing member opposite the blade member for connecting a line; and (d) a pair of gusset members rigidly attached to opposite sides of the bearing member for strengthening the bearing member, the gusset members being flush with the curved bottom surface for lateral stability of the puller, the gusset members also being rigidly attached to the tongue member for strengthening the rigid connection of the tongue member to the bearing member, wherein a horizontal force appled to the line produces an upward force component driving the blade member into engagement with the panel for movement of the pallet by the line to a desired location, and the bearing member functions as a skid against the surface supporting the pallet for facilitating the movement of the pallet.

13. A paller puller capable of engaging a loaded pallet having longitudinal ribs and a load-supporting panel connecting top surfaces of the ribs, the ribs resting directly on a surface supporting the pallet, the puller comprising:

(a) a bearing member having a cylindrically curved bottom surface, the curved bottom surface having a radius of from about 3½ inches to about 5 inches;

(b) a blade member extending tangentially from the curved bottom surface of the bearing member for contacting the panel; and (c) a tongue member rigidly connected to the bearing member opposite the blade member for connecting a line, wherein, when the puller is resting on a level surface with the blade extending 3⅝ inches above the level surface, the intersection of the line with the tongue is located from about 4 to about 6 inches above the level surface, wherein the distance between the end of the blade member and the intersection subtends an angle of from about 85 to about 105 degrees about a point of contact between the curved surface and the level surface, and wherein a horizontal force applied to the line produces an upward force component driving the blade member into engagement with the panel for movement of the pallet by the line to a desired location, and the bearing member functions as a skid against the surface supporting the pallet for facilitating the movement of the pallet.

* * * * *